US010053845B1

(12) United States Patent
Altimari

(10) Patent No.: US 10,053,845 B1
(45) **Date of Patent: *Aug. 21, 2018**

(54) SINK DRAIN STRAINER

(71) Applicant: Nicholas Altimari, Midlothian, VA (US)

(72) Inventor: Nicholas Altimari, Midlothian, VA (US)

( * ) Notice: Subject to any disclaimer, the term of this patent is extended or adjusted under 35 U.S.C. 154(b) by 13 days.

This patent is subject to a terminal disclaimer.

(21) Appl. No.: 15/437,037

(22) Filed: Feb. 20, 2017

Related U.S. Application Data

(63) Continuation of application No. 14/274,843, filed on May 12, 2014, now Pat. No. 9,593,474.

(60) Provisional application No. 61/938,773, filed on Feb. 12, 2014.

(51) Int. Cl.
*E03C 1/264* (2006.01)

(52) U.S. Cl.
CPC ..... *E03C 1/264* (2013.01)

(58) Field of Classification Search
CPC ..... E03C 1/26; E03C 1/264
See application file for complete search history.

(56) References Cited

U.S. PATENT DOCUMENTS

| | | | | |
|---|---|---|---|---|
| 4,471,497 | A * | 9/1984 | Riutort | E03C 1/264 4/286 |
| 2004/0107489 | A1* | 6/2004 | Caterina | E03C 1/264 4/290 |
| 2005/0279697 | A1* | 12/2005 | Stephenson | E03C 1/23 210/460 |
| 2010/0213111 | A1* | 8/2010 | Won | E03C 1/264 210/163 |

* cited by examiner

*Primary Examiner* — Janie Loeppke
(74) *Attorney, Agent, or Firm* — Michael Haynes PLC; Michael N. Haynes

(57) ABSTRACT

Certain exemplary embodiments can provide a system, machine, device, and/or manufacture relating to a sink drain strainer for a sink drain body coupled to a drain pipe, the sink drain body coupled to a sink that defines a sink bottom, the sink drain strainer, in an operative embodiment, configured to be placed within a drain aperture.

20 Claims, 7 Drawing Sheets

SINK DRAIN STRAINER

CROSS-REFERENCES TO RELATED APPLICATIONS

This application claims priority to, and incorporates by reference herein in its entirety, U.S. Provisional Patent Application 61/938,773, filed 12 Feb. 2014.

BRIEF DESCRIPTION OF THE DRAWINGS

A wide variety of potential embodiments of the strainer will be more readily understood through the following description of certain exemplary embodiments, with reference to the accompanying exemplary drawings in which.

DESCRIPTION

Figure 1:
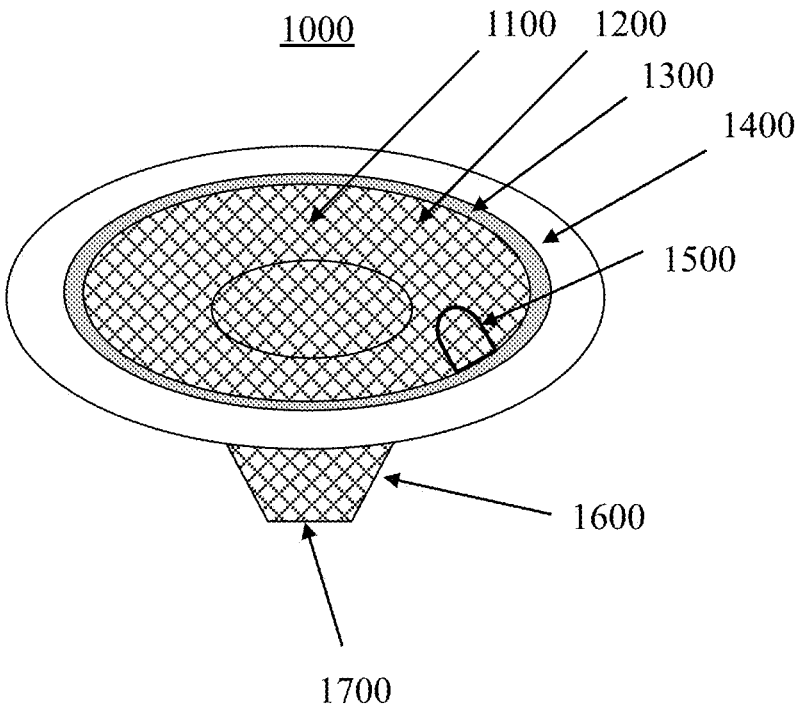
FIG. 1 is a perspective view of an exemplary sink drain strainer.

A typical kitchen sink is defined by one or more substantially bowl-like open-topped containers having a generally horizontal bottom that gently slopes toward a downward-facing outlet, which typically connects via drain piping or plumbing to a septic system, cesspool, and/or public sewer works. That connection is typically facilitated by a drain pipe flange that is supported by the sink bottom and is integrally connected to a short pipe-like drain body, which in turn is fluidly coupled and/or mechanically connected to the remainder of the drain piping, which might include a "P-trap" that is adapted to gravitationally capture some relatively large items that exit the sink through the drain body and/or provide a water seal to prevent gases from venting from the drain piping into the vicinity of the sink. To avoid plugging the drain piping and/or P-trap, a sink drain strainer device can be placed within and/or near the sink outlet. The strainer can be supported by the drain flange, and/or can be removable to facilitate cleaning of the strainer.

Certain exemplary embodiments can provide a sink drain strainer that can comprise: a cone-shaped basket that can be comprised of screen mesh material; a rigid supporting ring that can have an integrated lift tab; and/or an upward-angled outer flange that can be comprised of flexible, elastomeric material, including natural and/or synthetic materials, and which can contact the vertical wall of a sink's drain body; the strainer adapted to sit deep within the drain body and below the lowest part of the sink bottom. The screen mesh basket can be suitable for capturing solid debris flowing within fluid and/or water as it passes through the screen openings. The ring can serve as a rigid support for the screen mesh, as a platform for a low profile lifting tab, and/or as a support and/or connection point for an outer flexible flange that can be angled upward and/or can press outward on the drain body's vertical wall to eliminate gaps and/or to speed the downward flow of fluid and/or debris into the basket.

Certain exemplary embodiments can provide a sink drain strainer comprising:

1. a mesh screen basket that can define a shape ranging from substantially conical (potentially with a rounded and/or flattened vertex) to substantially hemispherical, the basket adapted for straining and/or substantially capturing solids suspended within a fluid, which can be a liquid, slurry, and/or foam, etc., that passes through the basket;
2. a steeply upwardly angled flexible flange that can provide a stationary snug fit, friction fit, and/or force fit against the inner circumferential wall of the drain body and/or a low drag flow of fluid into the basket;
3. a rigid ring that can be integral to the basket and/or encircled by the flange, the ring adapted to substantially maintain the shape of the basket's screen and/or the strainer's flange; and/or
4. a lift tab, which can be integral to the ring, and/or can ease removal of the strainer from the drain body.

Certain exemplary embodiments can provide a sink drain strainer that can utilize a screen mesh and/or other straining materials. Certain exemplary strainers can be recessed deep within the drain body and below the bottom of the sink. Certain exemplary embodiments of this strainer can be adapted to any size drain and therefore its application should not be limited to the described use stated herein. For example, embodiments can be adapted for use in bathroom sink drains, tub drains, shower drains, floor drains, storm water drains, and/or commercial sink drains, etc.

Certain exemplary strainers can provide for the passage of fluids, such as water, out of a sink and into its drain while capturing clog-inducing solids to prevent them from entering plumbing pipes, and eventually septic systems, cesspools, and/or public sewer works, etc. Certain exemplary strainers can be easily placed, removed, and/or cleaned, and/or can strain sink fluids and/or water substantially quickly, completely, and/or efficiently.

Certain exemplary embodiments can provide a stopperless strainer design. Certain exemplary embodiments can utilize a screen mesh basket, but can easily be adapted to other materials.

Certain exemplary embodiments can define an outer diameter that is smaller, equivalent to, or larger than the inner diameter of the drain body and/or the inner diameter of the drain's flange. Certain exemplary embodiments need not hang over the drain flange or be supported by it, but instead can sit within the drain body, which can allow for the strainer to sit below the lowest level of the sink bottom and/or the top of the drain flange. Certain exemplary embodiments can avoid placing the device where the circumferential edge of the strainer flange could create a dam that can capture fluid-borne solids between the sink bottom and the outer circumference of the flange and/or slow and/or prevent some and/or all of the fluid-borne solids and/or the fluids themselves from exiting the sink bottom and finding its way into the strainer and/or its basket and finally the drain piping. Certain exemplary embodiments can avoid a relatively slow, inefficient, water-wasting, unsanitary, and/or ultimately frustrating dish-rinsing operation.

Instead, certain exemplary embodiments can sit within the drain body, well below the sink bottom and/or drain flange's top, which can allow for a relatively quick rinse of solids into the drain body, through the strainer, and into the drain pipe. The fluid and/or debris flow can be aided by the unique design and/or use of materials, which can allow for deep placement of the strainer, such as entirely within the drain body.

For example, certain exemplary embodiments can provide a strainer having an outer circumference defined by a relatively steep, upwardly angled flexible flange, which can make substantially gap-free contact with the inner wall of the drain body, and which can ensure substantially complete straining and/or little to no leftover debris and/or solids in the sink or drain body. The recessed placement and upwardly angled flange can provide for a fast, low-drag flow of fluid and/or debris, which can take full advantage of gravity and/or aid the creation of a vortex of swirling water to quickly and/or substantially completely rinse the fluid, solids, and/or debris down into the sink strainer, which can save a substantial amount of water. In addition to the potential water savings, the increased effectiveness of the rinse operation can make for a more sanitary sink.

As another example, certain exemplary embodiments can provide the flexible flange with a textured upward-facing surface, the texture selected to help reduce and/or minimize drag that might slow fluid flow across the flange and/or cause debris to deposit on the flange.

As yet another example, certain exemplary embodiments can provide a flexible flange that is shaped and/or contoured with a plurality of circumferentially-distributed curved grooves that can help induce a vortex in a fluid that passes through the strainer, that vortex helping to increase the velocity of that fluid and/or help sweep debris off of the flange and into the basket.

Certain exemplary embodiments of the strainer can be easily removed from the drain body by pulling upward on a low profile finger tab that can be integrated into the rigid supporting ring, that can be fused to the mesh screen basket and/or the flexible outer flange. The contained debris can then be emptied into a trash container with a simple tap, and the strainer can then be rinsed off and/or sanitized by hand and/or machine washing. Certain exemplary embodiments can be constructed of dishwasher-safe materials capable of tolerating detergents and/or high temperature wash water.

Certain exemplary embodiments can provide a substantially cone-shaped strainer basket having a substantially flattened vertex and/or fashioned of finely perforated stainless steel, screen mesh formed from stainless steel wire, formed plastic, and/or elastomeric materials, including natural and/or synthetic materials, the basket adapted to allow fluid to easily pass through but to entrap potentially drain-clogging solids and/or debris, and/or undesired fluids.

Certain exemplary embodiments can gain strength and/or consistency of shape by incorporating a substantially flat and/or rigid ring, which can be formed of stainless steel and/or a hard plastic, and which can encircle and/or define the outer edge of the basket and/or have integrated within it a low profile tab that juts slightly into the basket's inner debris space for easy lifting by a finger.

Certain exemplary embodiments can provide a steep upwardly angled flexible flange made of elastomeric materials, including natural and/or synthetic materials such as silicone or similar flexible material, which can be connected to the rigid ring and/or an outer edge of the meshed basket-like screen on its inner aspect and/or on its outer circumference can make substantially gap-free contact with the inner wall of the drain body, thereby promoting relatively efficient and/or substantially complete straining, which can result in substantially no leftover debris in the sink, above the flange, and/or in the drain body above the strainer. This flange can be fabricated in a multitude of presentations such as transparent, translucent, and/or opaque, with solid, mixed, and/or patterned integral and/or exterior colors, and/or can be embossed with designs, prints, and/or logos. For example, the strainer flange can be colored to match a surface finish of the sink, the drain pipe, and/or the drain flange.

Referring to FIGS. 1-5, there is illustrated various exemplary embodiments of a sink drain strainer, generally designated by the numeral 1000. As shown, strainer 1000 can include a basket-like portion 1100 comprised of screen mesh 1200 having a substantially inverted cone configuration 1600 which terminates in a substantially flattened vertex at its lowest operational point 1700, which can serve as a leveling and/or stabilizing contact point when resting substantially squarely on substantially flat cross members 1800 often found at the low end of the drain body 1900. The upper portion of the mesh (i.e., the base of the cone) can terminate at a point where the rigid supporting circumferential ring 1300 can crimp down onto the outer circumference of 1200 mesh. Ring 1300 can be comprised of thermoplastic, a thermoset plastic, a rust resistant metal, or any other suitable rigid material. An upwardly angled substantially flexible annular flange 1400, which can be made of elastomeric material, including natural and/or synthetic materials, can be designed to make direct yet relatively low pressure contact with the inner wall of a drain body (which can prevent solids from bypassing the screen basket), to meet, attach to, chemically adhere to (e.g., upon drying, curing, vulcanization, and/or polymerizing of) the elastomeric material, and/or envelop rigid supporting circumference ring 1300, and/or to overlap a small portion of the outer aspect of the mesh material 1200 of basket 1100, destructively or non-destructively removably fusing together flange 1400, ring 1300, and/or basket 1100. Integrated into the substantially rigid supporting circumferential ring can be a low profile lift tab 1500 to facilitate the removal of strainer 1000 from the sink.

Certain exemplary embodiments of screen mesh 1200 (or mesh screen) can be constructed from any number of materials, metal, polymeric, and/or elastomeric, including natural and/or synthetic materials. The apertures of basket 1100 can be sized to allow a fluid, such as water, soap foam, oil, very finely ground food, sand, etc., to flow through the openings while trapping large pieces of solid material, such as food waste, shells, hair, paper, contact lenses, etc., that might be entrained in the fluid. The apertures can be of equal or varied sizes, and/or can be of any desired and/or closed shape, such as, for example, linear and/or curvilinear slots, circles, ellipses, squares, and/or triangles, etc.

Figure 2:
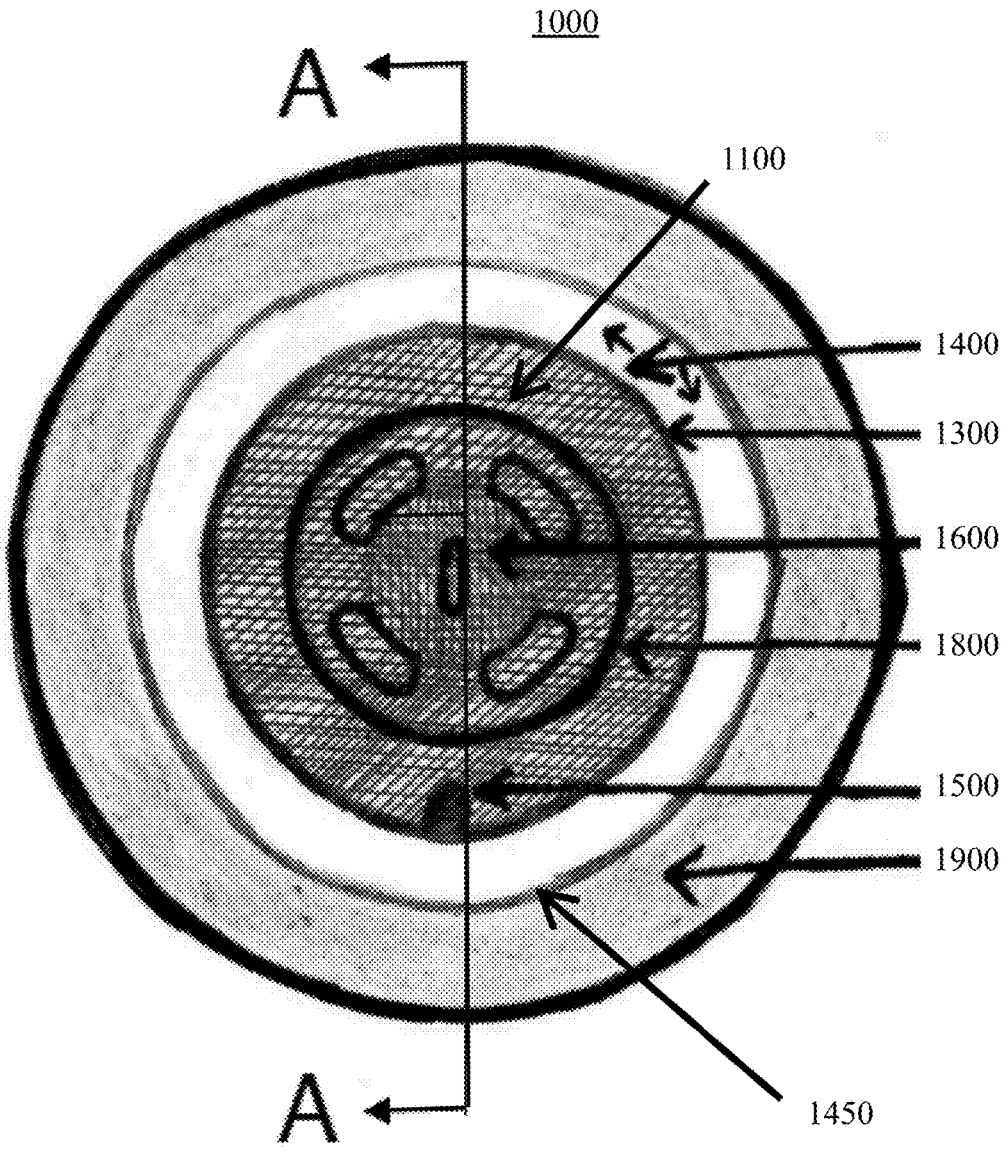
FIG. 2 is a top view of an exemplary sink drain strainer placed within a sink's drain body.

FIG. 2 is a top view of exemplary sink drain strainer 1000 placed within a sink's drain body 1900 and showing in the center of the figure the flattened vertex 1700 of strainer 1000 resting substantially squarely upon the steel cross members 1800 at the terminal end of the drain body 1900.

Figure 3:
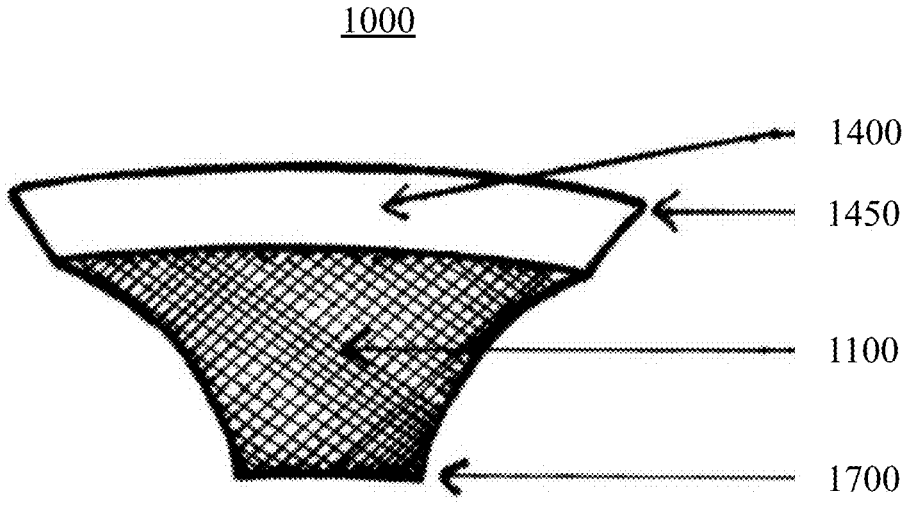
FIG. 3 is a side view of an exemplary sink drain strainer.
Figure 5:
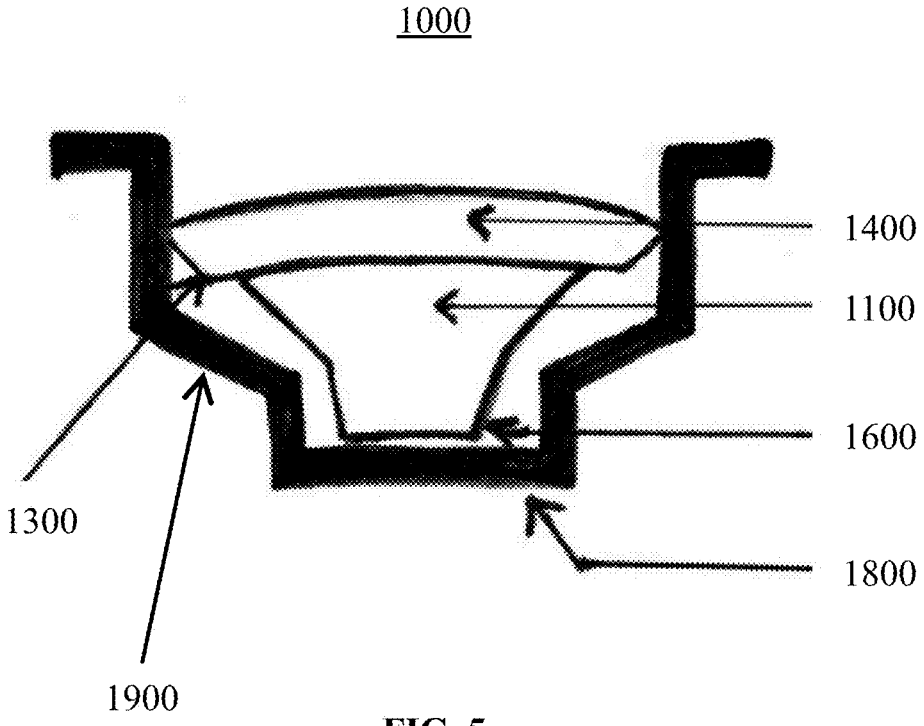
FIG. 5 is a cross-sectional view taken at section A-A of FIG. 2.

FIG. 3 is a side view of exemplary sink drain strainer 1000 and shows the steep angle of the silicone flange 1400 and the contact point 1450 that can meet with inner wall of the drain body 1900, which can be seen in FIG. 2 and FIG. 5.

Figure 4:
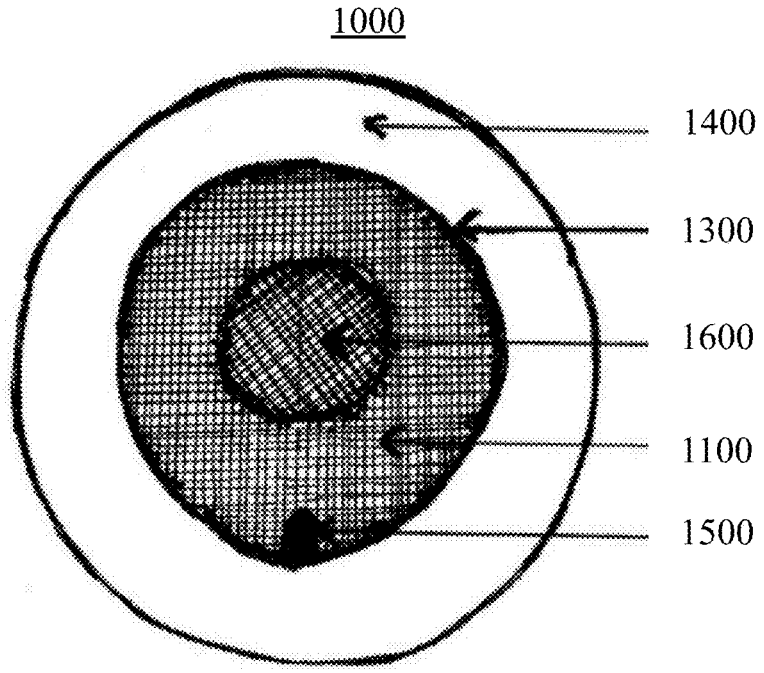
FIG. 4 is a bottom view of an exemplary sink drain strainer.

FIG. 4 is a bottom view of an exemplary sink drain strainer.

FIG. 5 is a cross-sectional view taken at section A-A of FIG. 2 and shows an operative position of strainer 1000 within drain body 1900 and how the outer circumference of annular flange 1400 can help to secure strainer 1000 within drain body 1900 and below the bottom surface of the sink by engaging the outer circumference and/or perimeter of flange 1400 with the inner circumferential surface and/or wall of drain body 1900. Also shown is how the substantially flattened vertex 1700 can rest substantially squarely upon the steel cross members 1800 at the terminal end of drain body 1900. Flange 1400 can have an annular width of between approximately 0.1 inches to approximately 1 inch (including every value and sub-range there between, such as 0.125, 0.18333, 0.25, 0.3, 0.375, 0.47, 0.5, 0.625, 0.75, and/or 0.833, etc. inches). The measurement of the annular width of flange 1400 can include the overlap of support ring 1300 and/or the outer aspect of the basket material 1200. Flange 1400 can comprise approximately one tenth to approximately one half of the radius of strainer 1000. The material of flange 1400 can be a flexible material as described above, which can enable easy placement and/or removal from the inside of drain body 1900 while encouraging flow onto into basket 1100 and/or preventing bypassing of basket 1200.

In use, strainer 1000 can be placed low within drain body 1900, with the base of the cone shaped basket 1100 (and/or major opening of the basket) facing upwards. As fluid is added to the sink, such as by running a faucet and/or dumping a container, the fluid can flow out of the sink bottom, over the drain flange, into drain body 1900 and into mesh screen basket 1100, where it can be strained for solid material exceeding the aperture size of the basket portion. Strainer 1000 can be removed from drain opening and the entrained solids can be properly discarded, such as by tapping the edge of basket 1100 to free the solids and then dumping them into a trash receptacle. Strainer 1000 then can be placed back into drain body 1900 and/or sanitized by hand and/or machine washing.

Figure 6:
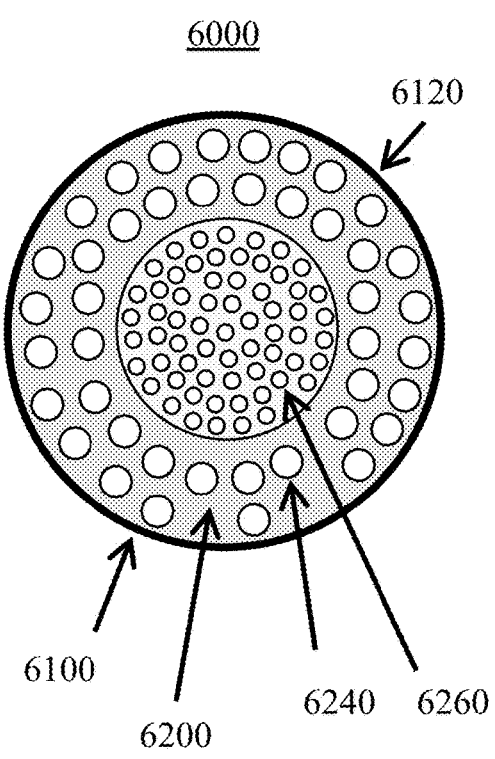
FIG. 6 is a top view of an exemplary embodiment of a device.

FIG. 6 is a top view of an exemplary embodiment of a device 6000 (which can be assembled with device 7000 of FIG. 7) comprising a strainer basket 6100, which can be formed from a mesh material 6200 having relatively large apertures 6240 near the operative top of basket 6100, and relatively smaller apertures 6260 near the operative bottom of basket 6100.

Figure 7:
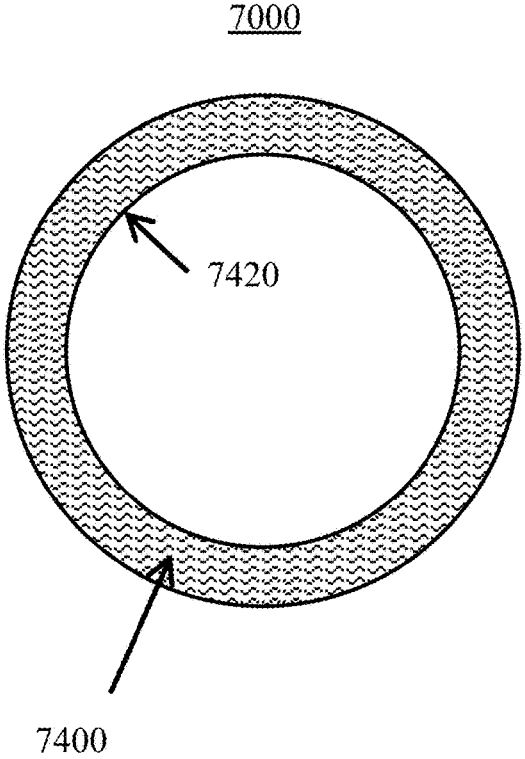
FIG. 7 is a top view of an exemplary embodiment of a device.

FIG. 7 is a top view of an exemplary embodiment of a device 7000 (which can be assembled with device 6000 of FIG. 6) comprising a flange 7400, which can be sized such that its inner circumference 7420 can elastically stretched around an outer circumference of a sink strainer basket, such as around outer circumference 6120 of basket 6100 of FIG. 6. Once inner circumference 7420 is stretched around an outer circumference of a sink strainer basket, the pair can form a sink strainer as described herein. Flange 7400 can be highly elastic and/or return to its original size and shape when the stress and strain of stretching is "unloaded".

Figure 8:
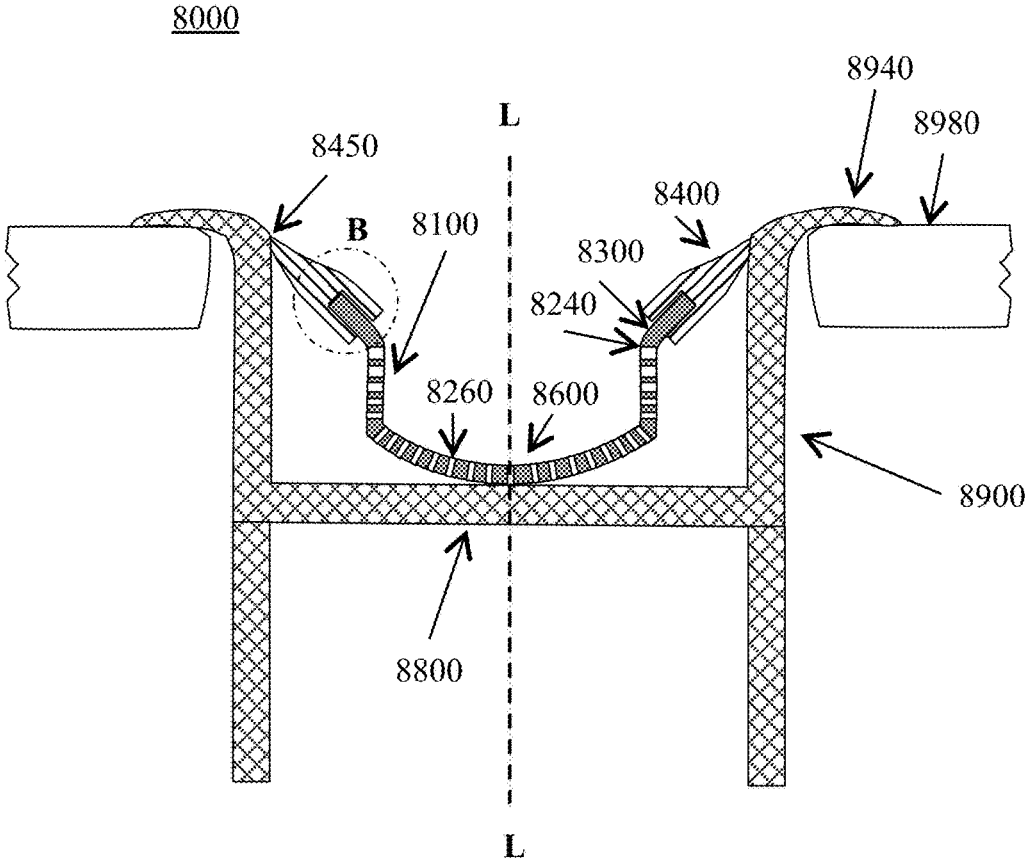
FIG. 8 is a cross-sectional view, such as can be taken at section A-A of FIG. 2.

FIG. 8 is a cross-sectional view, such as can be taken at section A-A of FIG. 2, of an exemplary embodiment of a sink strainer device 8000, which can be installed in a drain body 8900, such as below a flange 8940 of drain body 8900, and/or can rest on cross members 8800 of drain body 8900. Drain body flange 8940 can provide a substantially circumferential and/or sealing engagement with a sink 8980. Basket 8100 can define a rim 8300 that can provide a substantially circumferential and/or sealing engagement with an elastomeric flange 8400, which can provide a substantially circumferential and/or sealing engagement with drain body 8900, such as at strainer contact circumference 8450. Basket 8100 can define a plurality of relatively large apertures 8240 located near an operative top of basket 8100, and a plurality of relatively smaller apertures 8260 located near an operative bottom 8600 of basket 8100. As shown in FIG. 8, sink strainer device 8000 and/or drain body 8900 defines a strainer longitudinal axis L-L.

Figure 9:
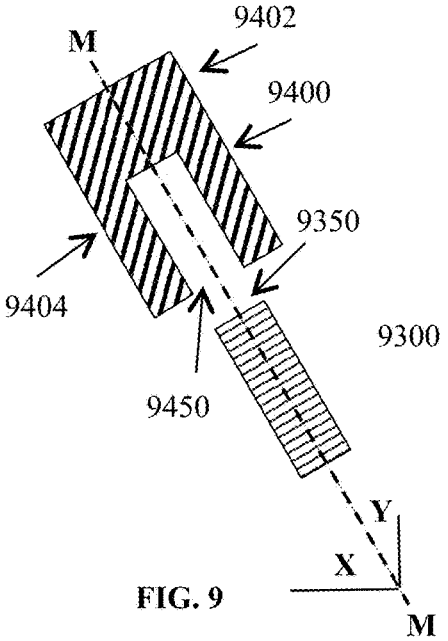
FIG. 9 is a close-up view of an exemplary embodiment of a cross-section of a rim.

FIG. 9 is a close-up view of an exemplary embodiment of a cross-section of a rim 9300 of a basket of a strainer. Rim 9300 can provide a substantially circumferential and/or sealing engagement with a flange 9400 of the strainer. Note that rim 9300 can have a consistent thickness such that the edge 9350 of rim 9300 is substantially less than or equal to the thickness of opening 9450 in flange 9400, thereby allowing for a running fit between the two, and/or ensuring that flange 9400 can relatively easily be disengaged from rim 9300. As shown in FIG. 9, flange 9400 defines an upstream surface 9402, a downstream surface 9404, a flange outer circumferential edge (shown in FIG. 8), and a substantially straight flange longitudinal axis M-M that extends at an angle X with respect to horizontal and/or complementary angle Y with respect to vertical (and/or axis L-L of FIG. 8). Note that flange longitudinal axis M-M is substantially collinear with the longitudinal axis of rim 9300 (not shown for clarity), which thus also extends at angles X and Y.

Figure 10:
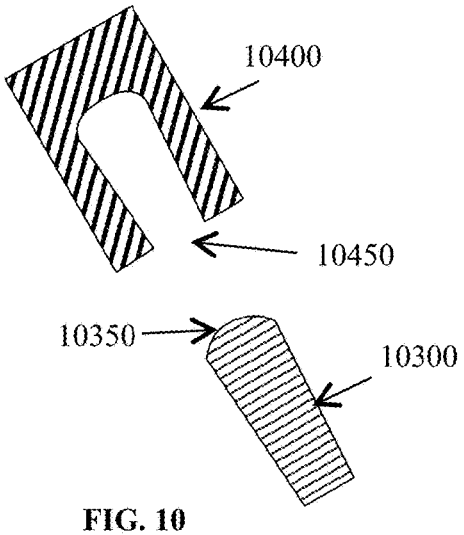
FIG. 10 is a close-up view of an exemplary embodiment of a cross-section of a rim.

FIG. 10 is a close-up view of an exemplary embodiment of a cross-section of a rim 10300 of a basket of a strainer. Rim 10300 can provide a substantially circumferential and/or sealing engagement with a flange 10400 of the strainer. Note that rim 10300 can have a tapered thickness where the edge 10350 of rim 10300 is larger than the opening 10450 in flange 10400, thereby allowing for a force and/or interference fit between the two, and/or ensuring that flange 10400 does not over-easily disengage from rim 10300.

Figure 11:
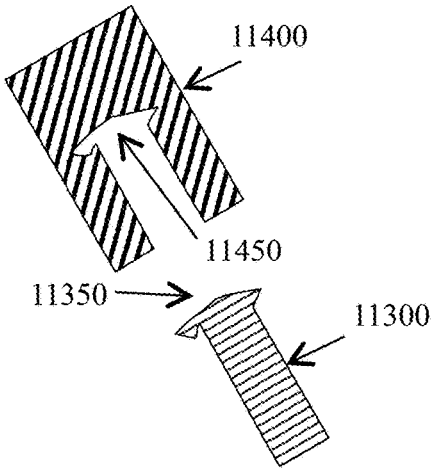
FIG. 11 is a close-up view of an exemplary embodiment of a cross-section of a rim.

FIG. 11 is a close-up view of an exemplary embodiment of a cross-section of a rim 11300 of a basket of a strainer. Rim 11300 can provide a substantially circumferential and/or sealing engagement with a flange 11400 of the strainer. Note that rim 11300 can define a barbed edge 11350 and/or flange 11400 can define an inverted barb receiver 11450, thereby allowing for a force and/or interference fit between the two, and/or ensuring that flange 11400 does not over-easily disengage from rim 11300.

Figure 12:
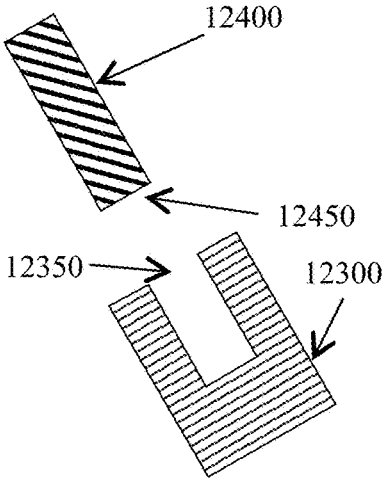
FIG. 12 is a close-up view of an exemplary embodiment of a cross-section of a rim.

FIG. 12 is a close-up view of an exemplary embodiment of a cross-section of a rim 12300 of a basket of a strainer. Rim 12300 can provide a substantially circumferential and/or sealing engagement with a flange 12400 of the strainer. Note that rim 12300 can define a flange receiver 12350 and/or flange 12400 can define a rim engager 12450, thereby allowing for a running fit or a force fit between the two.

Certain exemplary embodiments can provide device comprising a sink drain strainer for sink drain body coupled to a drain pipe, the sink drain body coupled to a sink that defines a sink bottom, the sink drain strainer, in an operative embodiment, configured to:

- be placed wholly within a drain aperture defined by a substantially circumferential wall of the sink drain body;
- be placed below the sink bottom;
- be placed below a top surface of a drain flange defined by the sink drain body; and/or
- substantially prevent debris, entrained in a fluid and having a minimum dimension greater than a predetermined opening size, from downwardly exiting the sink drain strainer into a drain pipe coupled to the sink drain body;

wherein:

the sink drain strainer comprises a flexible flange and a basket;

the flexible flange defines a flange outer circumferential edge that is configured to, in an operative embodiment, substantially circumferentially and sealingly contact the substantially circumferential wall of the sink drain body when said flange outer circumferential edge is at an angle of between approximately 35 degrees and approximately 75 degrees from horizontal;

the flexible flange is configured to, in an operative embodiment, substantially sealingly engage with a rim of the basket;

the sink drain strainer is configured to be supported by cross-bars of the sink drain body;

the basket has a substantially flat-bottomed conical shape;

the flexible flange is configured to, in an operative embodiment, non-destructively releaseably engage with the rim of the basket;

the flexible flange is configured to adhere to the rim;

the flexible flange defines a receiving channel configured for receiving the rim of the basket;

at least one of the flexible flange and the rim is configured to non-destructively resist disengagement of the flexible flange from the rim;

the flexible flange is configured to non-destructively engage with the rim via a force fit;

the flexible flange has a surface finish configured to resist depositing of the fluid-entrained debris thereon;

the flexible flange is configured to induce a vortex in fluid entering the sink drain strainer;

the flexible flange is configured to substantially direct the fluid-entrained debris into the basket;

in an operative embodiment, the flexible flange is not in direct contact with the top surface of the drain flange;

the flexible flange has a Shore A durometer of between approximately 20 and approximately 70;

the basket has a substantially flat-bottomed cone shape;

the basket defines:

a first plurality of apertures having a first predetermined opening size; and a second plurality of apertures having a second predetermined opening size;

wherein the second predetermined opening size is greater than the first predetermined opening size;

the basket defines:

a first plurality of apertures having a first predetermined opening size; and a second plurality of apertures having a second predetermined opening size;

wherein:

the second predetermined opening size is greater than the first predetermined opening size; and in an operative embodiment, the second plurality of apertures is located above the first plurality of apertures;

the basket is formed from stainless steel;

the rim is substantially rigid;

the sink drain strainer comprises a lift tab;

the sink drain strainer comprises a lift tab that is integral to the rim of the basket;

the sink drain strainer comprises a grasper attached to the basket and sized for direct manual grasping to remove the sink drain strainer from the sink drain body;

the flexible flange is integral with the basket; and/or the flexible flange is distinct from the basket.

Definitions

When the following terms are used substantively herein, the accompanying definitions apply. These terms and definitions are presented without prejudice, and, consistent with the application, the right to redefine these terms via amendment during the prosecution of this application or any application claiming priority hereto is reserved. For the purpose of interpreting a claim of any patent that claims priority hereto, each definition in that patent functions as a clear and unambiguous disavowal of the subject matter outside of that definition.

a—at least one.

about—around and/or approximately.

above—at a higher level.

across—from one side to another.

activity—an action, act, step, and/or process or portion thereof.

adapt—to design, make, set up, arrange, shape, configure, and/or make suitable and/or fit for a specific purpose, function, use, and/or situation.

adapted to—suitable, fit, and/or capable of performing a specified function.

adapter—a device used to effect operative compatibility between different parts of one or more pieces of an apparatus or system.

adhere—to stick and/or bond to.

after—following in time and/or subsequent to.

along—through, on, beside, over, in line with, and/or parallel to the length and/or direction of; and/or from one end to the other of and—in conjunction with.

and/or—either in conjunction with or in alternative to.

angle—a measure of rotation and/or inclination between a ray and a reference ray and/or plane.

any—one, some, every, and/or all without specification.

aperture—an opening, hole, gap, passage, and/or slit.

apparatus—an appliance and/or device for a particular purpose.

approximately—about and/or nearly the same as.

around—about, surrounding, and/or on substantially all sides of; and/or approximately.

as long as—if and/or since.

associate—to join, connect together, accompany, and/or relate.

at—in, on, and/or near.

at least—not less than, and possibly more than.

at least one—not less than one, and possibly more than one.

attach—to join or secure together.

basket—a container made of interwoven strips of pliable materials, such as cane, straw, thin wood, and/or plastic and/or something resembling such a container in appearance and/or function.

below—beneath; in a lower place; and/or less than.

between—in a separating interval and/or intermediate to.

body—a main and/or central part.

bottom—a lowest part of an object relative to a point of reference, the object in a predetermined orientation relative to the point of reference.

by—via and/or with the use and/or help of can—is capable of, in at least some embodiments.

cause—to bring about, provoke, precipitate, produce, elicit, be the reason for, result in, and/or effect.

channel—a defined passage, conduit, and/or groove for conveying one or more fluids.

circuit—an electrically conductive pathway and/or a communications connection established across two or more switching devices comprised by a network and between corresponding end systems connected to, but not comprised by the network.

circumferential—of, at, or near the circumference; surrounding; lying along the outskirts.

composition of matter—a combination, reaction product, compound, mixture, formulation, material, and/or composite formed by a human and/or automation from two or more substances and/or elements.

comprising—including but not limited to.

cone—a solid whose surface is generated by a line passing through a fixed point and a fixed plane curve not containing the point, consisting of two equal sections joined at a vertex.

configure—to design, arrange, set up, shape, and/or make suitable and/or fit for a specific purpose, function, use, and/or situation.

configure—to make suitable and/or fit for a specific use and/or situation.

conical—of, relating to, or shaped like a cone.

connect—to link, join, and/or fasten together.

contact—to touch and/or come together.

containing—including but not limited to.

convert—to transform, adapt, and/or change.

corresponding—related, associated, accompanying, similar in purpose and/or position, conforming in every respect, and/or equivalent and/or agreeing in amount, quantity, magnitude, quality, and/or degree.

couple—to connect and/or link by any known way, including mechanical, fluidic, hydraulic, pneumatic, acoustic, electrical, magnetic, optical, etc.

coupleable—capable of being joined, connected, and/or linked together.

coupling—linking in some fashion.

create—to make, form, produce, generate, bring into being, and/or cause to exist.

cross-bars—a pair of substantially perpendicular and substantially horizontally extending bars that prevent very large object from entering a drain pipe.

debris—the substantially solid remains of something that has been destroyed or broken up.

define—to establish the meaning, relationship, outline, form, and/or structure of; and/or to precisely and/or distinctly describe and/or specify.

degree—a planar unit of angular measure equal in magnitude to 1/360 of a complete revolution.

deposit—to settle, place, or set down.

derive—to receive, obtain, and/or produce from a source and/or origin.

determine—to find out, obtain, calculate, decide, deduce, ascertain, and/or come to a decision, typically by investigation, reasoning, and/or calculation.

device—a machine, manufacture, and/or collection thereof.

dimension—an extension in a given direction and/or a measurement in length, width, or thickness.

direct—to point, aim, and/or send toward a place or object.

direct contact—a coming together or touching, as of objects or surfaces.

disengage—to release from something that holds fast, connects, obliges, and/or entangles.

downward—in, to, and/or toward a lower place, level, and/or position.

downwardly—in a downward manner.

drain—a pipe or channel by which liquid is drawn off.

durometer—a measure of a hardness of a material, wherein hardness is defined as a material's resistance to permanent indentation.

each—every one of a group considered individually.

edge—a periphery, border, and/or boundary.

effective—sufficient to bring about, provoke, elicit, and/or cause.

embodiment—an implementation, manifestation, and/or a concrete representation, such as of a concept.

engage—to mesh, mate, connect, and/or interlock and/or to contact, cause to contact, interact, and/or cause to interact.

enter—to come and/or flow into.

entrain—to carry (e.g., suspended particles and/or debris) along in a current.

estimate—(n) a calculated value approximating an actual value; (v) to calculate and/or determine approximately and/or tentatively.

exemplary—serving as an example, model, instance, and/or illustration.

exit—to depart, leave, and/or go out of first—an initial element in a set.

fit—adapted to be of the right size and/or shape for; adapted to conform to a shape of.

flange—a protruding rim, edge, rib, collar, and/or tube, etc.

flat—substantially planar.

flexible—capable of bending and/or flexing without a tendency to break.

fluid—a continuous, amorphous substance whose molecules move freely past one another and that has the tendency to assume the shape of its container; and/or a liquid and/or gas.

fluid—a liquid, slurry, vapor, mist, cloud, plume, and/or foam, etc.

for—with a purpose of force fit—a fit between two objects obtained by applying substantial pressure to overcome friction and/or deform at least one of the objects.

formed—constructed.

from—used to indicate a source, origin, and/or location thereof.

further—in addition.

generate—to create, produce, render, give rise to, and/or bring into existence.

grasp—to clasp, take hold of, and/or seize firmly with and/or as if with the hand.

grasper—a structure configured for grasping by a human.

greater—larger and/or more than.

greater than—larger and/or more than.

having—possessing, characterized by, comprising, and/or including but not limited to.

horizontal—parallel to and/or in the plane of the horizon.

including—having, but not limited to, what follows.

induce—to bring about and/or cause to occur.

initialize—to prepare something for use and/or some future event.

install—to connect or set in position and prepare for use.

integral—formed or united into another entity.

into—to a condition, state, or form of is—to exist in actuality.

lift—to raise and/or carry from a lower to a higher position.

located—situated in a particular spot, region, and/or position.
manual—done by, used by, and/or operated with one or more hands of a human.
may—is allowed and/or permitted to, in at least some embodiments.
may—is allowed and/or permitted to, in at least some embodiments.
method—one or more acts that are performed upon subject matter to be transformed to a different state or thing and/or are tied to a particular apparatus, said one or more acts not a fundamental principal and not preempting all uses of a fundamental principal.
minimum—a smallest and/or lowest level.
near—a distance of less than approximately [X].
no—an absence of and/or lacking any.
non-destructively—of, relating to, or being a process that does not result in damage to the material under use, investigation, and/or testing.
not—a negation of something.
one—being and/or amounting to a single unit, individual, and/or entire thing, item, and/or object.
opening—an aperture and/or open space serving as a passage and/or gap.
operable—practicable and/or fit, ready, and/or configured to be put into its intended use and/or service.
operative—being in effect; operating.
operative embodiment—an implementation that is in operation and/or is working as designed.
or—a conjunction used to indicate alternatives, typically appearing only before the last item in a group of alternative items.
outer—farther than another from the center and/or middle.
outside—beyond a range, boundary, and/or limit; and/or not within.
per—for each and/or by means of.
pipe—a hollow cylinder and/or or tube used to conduct a liquid, gas, and/or finely divided solid.
place—to put in a particular place and/or position.
plurality—the state of being plural and/or more than one.
portion—a part, component, section, percentage, ratio, and/or quantity that is less than a larger whole.
pre-—a prefix that precedes an activity that has occurred beforehand and/or in advance.
predetermine—to determine, decide, and/or establish in advance.
prevent—to hinder, avert, and/or keep from occurring.
prior—before and/or preceding in time or order.
probability—a quantitative representation of a likelihood of an occurrence.
product—something produced by human and/or mechanical effort.
project—to calculate, estimate, or predict.
provide—to furnish, supply, give, convey, send, and/or make available.
range—a measure of an extent of a set of values and/or an amount and/or extent of variation.
ratio—a relationship between two quantities expressed as a quotient of one divided by the other.
receive—to get as a signal, take, acquire, and/or obtain.
receiving—obtaining, taking, and/or acquiring.
recommend—to suggest, praise, commend, and/or endorse.
reduce—to make and/or become lesser and/or smaller.
releaseably—capable of being substantially non-destructively freed from something that binds, fastens, and/or holds back.
remove—to eliminate, delete, move from a place and/or position occupied, and/or to transfer and/or convey from one place to another.
repeat—to do again and/or perform again.
repeatedly—again and again; repetitively.
request—to express a desire for and/or ask for.
resist—to avoid, act, and/or remain firm against and/or in opposition to the actions, effects, and/or force of.
result—(n.) an outcome and/or consequence of a particular action, operation, and/or course; (v.) to cause an outcome and/or consequence of a particular action, operation, and/or course.
rigid—substantially inflexible.
rim—the usually curved and/or circular outer region, border, and/or edge of an object.
said—when used in a system or device claim, an article indicating a subsequent claim term that has been previously introduced.
seal—to shut close, keep close, make fast, keep secure, and/or prevent leakage.
second—following a first thing in an ordering, such as in time, position, etc.
select—to make a choice or selection from alternatives.
set—a related plurality of predetermined elements; and/or one or more distinct items and/or entities having a specific common property or properties.
shape—a characteristic surface, outline, and/or contour of an entity.
Shore A—a type of durometer measurement.
sink—a water basin configured to be operatively fixed to a wall, floor, and/or countertop and generally having a drain opening and a piped supply of water.
size—(n) physical dimensions, proportions, magnitude, amount, and/or extent of an entity; (v) to determine physical dimensions, proportions, magnitude, amount, and/or extent of an entity; and/or to make, cut, construct, and/or shape to a required size.
species—a class of individuals and/or objects grouped by virtue of their common attributes and assigned a common name; a division subordinate to a genus.
stainless steel—any of various steels alloyed with at least 10 percent chromium and sometimes containing other elements and that are resistant to corrosion or rusting associated with exposure to water and moist air.
steel—a generally hard, strong, durable, malleable alloy of iron and carbon, usually containing between 0.2 and 1.5 percent carbon, often with other constituents such as manganese, chromium, nickel, molybdenum, copper, tungsten, cobalt, or silicon, depending on the desired alloy properties, and widely used as a structural material.
store—to place, hold, and/or retain data, typically in a memory.
strainer—a filter-like device configured to retain larger pieces while smaller pieces and liquids pass through.
substantially—to a considerable, large, and/or great, but not necessarily whole and/or entire, extent and/or degree.
support—to bear the weight of
surface—any face and/or outer boundary of a body, object, and/or thing.
surface finish—a surface roughness of an object, as measured by a surface profile.

system—a collection of mechanisms, devices, machines, articles of manufacture, processes, data, and/or instructions, the collection designed to perform one or more specific functions.

tab—a relatively small strip, attachment, and/or protrusion.

that—used as the subject or object of a relative clause.

thereon—on or upon a defined person, place, and/or thing.

through—across, among, between, and/or in one side and out the opposite and/or another side of.

to—a preposition adapted for use for expressing purpose.

top—an uppermost point and/or region relative to a predetermined orientation of an object.

transform—to change in measurable: form, appearance, nature, and/or character.

transmit—to send as a signal, provide, furnish, and/or supply.

treatment—an act, manner, or method of handling and/or dealing with someone and/or something.

upon—immediately or very soon after; and/or on the occasion of.

use—to put into service.

via—by way of and/or utilizing.

via—by way of and/or utilizing.

vortex—a spiral motion of fluid within a limited area, especially a whirling mass of water or air that sucks everything near it toward its center.

wall—a partition, structure, and/or mass that serves to enclose, divide, separate, segregate, define, and/or protect a volume and/or to support a floor, ceiling, and/or another wall.

weight—a force with which a body is attracted to Earth or another celestial body, equal to the product of the object's mass and the acceleration of gravity; and/or a factor and/or value assigned to a number in a computation, such as in determining an average, to make the number's effect on the computation reflect its importance, significance, preference, impact, etc.

when—at a time and/or during the time at which.

wherein—in regard to which; and; and/or in addition to.

wholly—entirely with—accompanied by.

with regard to—about, regarding, relative to, and/or in relation to.

within—inside the limits of.

zone—a region and/or volume having at least one predetermined boundary.

Note

Various substantially and specifically practical and useful exemplary embodiments are described herein, textually and/or graphically, including the best mode, if any, known to the inventor(s), for implementing the described subject matter by persons having ordinary skill in the art. Any of numerous possible variations (e.g., modifications, augmentations, embellishments, refinements, and/or enhancements, etc.), details (e.g., species, aspects, nuances, and/or elaborations, etc.), and/or equivalents (e.g., substitutions, replacements, combinations, and/or alternatives, etc.) of one or more embodiments described herein might become apparent upon reading this document to a person having ordinary skill in the art, relying upon his/her expertise and/or knowledge of the entirety of the art and without exercising undue experimentation. The inventor(s) expects skilled artisans to implement such variations, details, and/or equivalents as appropriate, and the inventor(s) therefore intends for the described subject matter to be practiced other than as specifically described herein. Accordingly, as permitted by law, the described subject matter includes and covers all variations, details, and equivalents of that described subject matter. Moreover, as permitted by law, every combination of the herein described characteristics, functions, activities, substances, and/or structural elements, and all possible variations, details, and equivalents thereof, is encompassed by the described subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any described subject matter unless otherwise stated. No language herein should be construed as indicating any described subject matter as essential to the practice of the described subject matter.

Thus, regardless of the content of any portion (e.g., title, field, background, summary, description, abstract, drawing figure, etc.) of this document, unless clearly specified to the contrary, such as via explicit definition, assertion, or argument, or clearly contradicted by context, with respect to any claim, whether of this document and/or any claim of any document claiming priority hereto, and whether originally presented or otherwise:

there is no requirement for the inclusion of any particular described characteristic, function, activity, substance, or structural element, for any particular sequence of activities, for any particular combination of substances, or for any particular interrelationship of elements;

no described characteristic, function, activity, substance, or structural element is "essential";

any two or more described substances can be mixed, combined, reacted, separated, and/or segregated;

any described characteristics, functions, activities, substances, and/or structural elements can be integrated, segregated, and/or duplicated;

any described activity can be performed manually, semi-automatically, and/or automatically;

any described activity can be repeated, any activity can be performed by multiple entities, and/or any activity can be performed in multiple jurisdictions; and any described characteristic, function, activity, substance, and/or structural element can be specifically excluded, the sequence of activities can vary, and/or the interrelationship of structural elements can vary.

The use of the terms "a," "an," "said," "the," and/or similar referents in the context of describing various embodiments (especially in the context of any claims presented herein or in any document claiming priority hereto) are to be construed to cover both the singular and the plural, unless otherwise indicated herein or clearly contradicted by context.

The terms "comprising," "having," "including," and "containing" are to be construed as open-ended terms (i.e., meaning "including, but not limited to") unless otherwise noted.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate sub-range defined by such separate values is incorporated into and clearly implied as being presented within the specification as if it were individually recited herein. For example, if a range of 1 to 10 is described, even implicitly, unless otherwise stated, that range necessarily includes all values there between, such as for example, 1.1, 2.5, 3.335, 5, 6.179, 8.9999, etc., and includes all sub-range there between, such as for example, 1 to 3.65, 2.8 to 8.14, 1.93 to 9, etc.

When any phrase (i.e., one or more words) described herein or appearing in a claim is followed by a drawing element number, that drawing element number is exemplary and non-limiting on the description and claim scope.

No claim of this document or any document claiming priority hereto is intended to invoke paragraph six of 35 USC 112 unless the precise phrase "means for" is followed by a gerund.

Any information in any material (e.g., a patent document such as a United States patent or United States patent application, or a non-patent reference, such as a book, article, web page, etc.) that has been incorporated by reference herein, is incorporated by reference herein in its entirety to its fullest enabling extent permitted by law yet only to the extent that no conflict exists between such information and the other statements and drawings set forth herein. In the event of such conflict, including a conflict that would render invalid any claim herein or seeking priority hereto, then any such conflicting information in such material is specifically not incorporated by reference herein. Any specific information in any portion of any material that has been incorporated by reference herein that identifies, criticizes, or compares to any prior art is not incorporated by reference herein.

Within this document, and during prosecution of any patent application related hereto (including any patent application claiming priority hereto) any reference to any claimed subject matter is intended to reference the precise language of the then-pending claimed subject matter at that particular point in time only.

Accordingly, every portion (e.g., title, field, background, summary, description, abstract, drawing figure, etc.) of this document, and any provided definitions of the phrases used herein, is to be regarded as illustrative in nature, and not as restrictive. The scope of subject matter protected by any claim of any patent that issues based on this document is defined and limited only by the precise language of that claim (and all legal equivalents thereof) and any provided definition of any phrase used in that claim, as informed by the context of this document.

What is claimed is:

1. A device comprising:

a sink drain strainer for a sink drain body coupled to a drain pipe, the sink drain body coupled to a sink that defines a sink bottom, the device, in an operative embodiment, configured to:

be placed wholly: below the entirety of the sink bottom; and below a top surface of a drain flange defined by the sink drain body; wherein:

the sink drain strainer comprises a flexible flange and a basket that defines a rim configured to engage with the flexible flange;

the flexible flange defines a substantially straight flange longitudinal axis and a flange outer circumferential edge that is configured to, in an operative embodiment, substantially circumferentially and sealingly contact a substantially circumferential wall of the sink drain body at an angle of between approximately 35 degrees and approximately 75 degrees from horizontal;

the flange longitudinal axis is substantially collinear with a longitudinal axis of the rim.

2. The device of claim 1, wherein:

the sink drain strainer is configured to be operatively supported by cross-bars of the sink drain body.

3. The device of claim 1, wherein:

the basket has a substantially flat-bottomed conical shape.

4. The device of claim 1, wherein:

the flexible flange is configured to, in an operative embodiment, non-destructively releaseably engage with the rim of the basket.

5. The device of claim 1, wherein:

the flexible flange defines a receiving channel configured for receiving the rim of the basket.

6. The device of claim 1, wherein:

at least one of the flexible flange and the rim is configured to non-destructively resist disengagement of the flexible flange from the rim.

7. The device of claim 1, wherein:

the flexible flange is configured to adhere to the rim.

8. The device of claim 1, wherein:

the flexible flange is configured to induce a vortex in fluid entering the sink drain strainer.

9. The device of claim 1, wherein:

the flexible flange is configured to substantially direct fluid-entrained debris into the basket.

10. The device of claim 1, wherein:

in an operative embodiment, the flexible flange is not in direct contact with the top surface of the drain flange.

11. The device of claim 1, wherein:

the basket has a substantially flat-bottomed cone shape.

12. The device of claim 1, wherein:

the basket defines:

a first plurality of apertures having a first predetermined opening size; and a second plurality of apertures having a second predetermined opening size;

wherein:

the second predetermined opening size is greater than the first predetermined opening size; and in an operative embodiment, the second plurality of apertures is located above the first plurality of apertures.

13. The device of claim 1, wherein:

the sink drain strainer comprises a lift tab that is integral to the rim of the basket.

14. The device of claim 1, wherein:

the sink drain strainer comprises a grasper attached to the basket and sized for direct manual grasping to remove the sink drain strainer from the sink drain body.

15. The device of claim 1, wherein:

in an operative embodiment, the device is configured to be placed wholly within a drain aperture defined by a substantially circumferential wall of the sink drain body.

16. The device of claim 1, wherein:

in an operative embodiment, the device is configured to substantially prevent debris, entrained in a fluid and having a minimum dimension greater than a predetermined opening size, from downwardly exiting the sink drain strainer into a drain pipe coupled to the sink drain body.

17. The device of claim 1, wherein:

in an operative embodiment, the device is configured to encourage debris to exit the sink bottom and then enter the sink drain body before then entering the basket.

18. The device of claim 1, wherein:

the flexible flange is configured to, in an operative embodiment, substantially sealingly engage with a rim of the basket.

19. A sink drain strainer for a sink drain body coupled to a drain pipe and to a sink that defines a sink bottom, the sink drain strainer comprising a flange and a basket, the flange defining:

a flange outer circumferential edge that is configured to, in an operative embodiment, substantially circumferentially and substantially sealingly contact a substantially vertically extending wall of the sink drain body; and a substantially straight flange longitudinal axis that is configured to intersect the substantially vertically extending wall at an upward angle with respect to horizontal;

wherein:

the basket defines a rim configured to engage with the flange; and the flange longitudinal axis is substantially collinear with a longitudinal axis of the rim.

20. A sink drain strainer comprising:

a basket; and a flange coupled to the basket;

wherein:

the sink drain strainer is configured to operatively fit within a sink drain body that is coupled to a drain pipe and to a sink that defines a sink bottom; and the flange defines a substantially straight flange longitudinal axis that is configured to intersect a substantially vertically extending wall of the sink drain body at an angle of between approximately 35 degrees and approximately 75 degrees from horizontal wherein:

the flange is coupled with a rim of the basket; and the flange longitudinal axis is substantially collinear with a longitudinal axis of the rim.

* * * * *